United States Patent [19]

Askew et al.

[11] 4,097,474

[45] Jun. 27, 1978

[54] PROCESS FOR SULFURIZING NORBORNENYL COMPOUNDS

[75] Inventors: Herbert Frank Askew; Gerald John Joseph Jayne, both of Wokingham; John Scotchford Elliott, Beaconsfield, all of England

[73] Assignee: Edwin Cooper and Company Limited, Bracknell, England

[21] Appl. No.: 664,547

[22] Filed: Mar. 8, 1976

Related U.S. Application Data

[60] Continuation-in-part of Ser. No. 541,995, Jan. 17, 1975, abandoned, which is a division of Ser. No. 459,938, Apr. 11, 1974, Pat. No. 3,882,031.

[30] Foreign Application Priority Data

Apr. 12, 1973 United Kingdom ..... 17728/73

[51] Int. Cl.[2] ..... C07G 17/00

[52] U.S. Cl. ..... 260/139; 260/125; 260/327 H

[58] Field of Search ..... 260/125, 139, 327 H

[56] References Cited

U.S. PATENT DOCUMENTS

| | | | |
|---|---|---|---|
| 2,338,829 | 1/1944 | Werntz | 260/327 H |
| 2,481,140 | 9/1949 | Movis et al. | 260/139 |
| 3,088,935 | 5/1963 | Krespan | 260/327 H |
| 3,523,926 | 8/1970 | Mirviss | 260/139 |
| 3,586,700 | 6/1971 | Kurtz et al. | 260/327 H |
| 3,632,566 | 1/1972 | Coleman | 260/125 |

*Primary Examiner*—Delbert R. Phillips
*Attorney, Agent, or Firm*—Donald L. Johnson; Robert A. Linn; Joseph D. Odenweller

[57] ABSTRACT

Norbornenyl compounds such as dicyclopentadiene are sulfurized by reaction with a controlled amount of sulfur in the absence of a solvent or using a non-polar solvent to give a normally liquid oil-soluble sulfur-containing compound useful as a lubricating oil additive.

40 Claims, No Drawings

PROCESS FOR SULFURIZING NORBORNENYL COMPOUNDS

PRIOR APPLICATIONS

This application is a Continuation-in-Part of application Ser. No. 541,995, filed Jan. 17, 1975, now abandoned which in turn is a Division of application Ser. No. 459,938, filed Apr. 11, 1974, now U.S. Pat. No. 3,882,031.

BACKGROUND

This invention relates to sulfurized products having utility as lubricant additives and lubricating compositions containing them. The invention also relates to a process for preparing sulfurized products, the products so prepared and lubricating compositions containing such products.

Antioxidant additives used in lubricating oils, particularly, but not exclusively, automotive lubricants, require a combination of properties which is difficult to meet in practice. Such additives must, of course, impart a high degree of resistance to oxidation to the lubricant, but in addition must be reasonably inexpensive, must be compatible with various other additives commonly used in lubricants, must have adequate thermal stability and must satisfy various other criteria of suitability, such as the ability to protect copper-lead bearings from corrosion. Very many different types of antioxidants have been proposed, and in some cases have been commercially used on a comparatively small scale. However, for many years the type of antioxidants which have been widely used as the most suitable general purpose antioxidants for automotive and other lubricants are metal, particularly zinc, salts of di-hydrocarbyl dithiophosphoric acids.

However, the need for lubricant developments to keep pace with engine developments has given rise recently to difficulties in the use of metal dithiophosphate salts as antioxidants. The metal content of these additives is a source of ash and there is a growing tendency for the quality standards laid down by manufacturers and other interested organizations to specify low-ash lubricant formulations for modern engines. Attempts have been made to develop dithiophosphate derivatives, which do not contain metal, in order to meet these requirements. However, such developments have been forestalled, at least to some extent, by yet another development in engine design, namely the use of catalytic devices in engine exhausts to minimize pollution caused by vehicle emissions. The catalysts used in such devices are sensitive to phosphorus compounds and can become poisoned and ineffective if exposed to such compounds. Consequently, the need has arisen for antioxidants which do not contain metal or phosphorus, and yet still meet all the requirements for antioxidants formerly satisfied by the metal dithiophosphates.

Sulfurized norbornenyl compounds have been previously made. Kurtz et al., U.S. Pat. No. 3,586,700, describes the preparation of such compounds. According to Kurtz et al it is necessary to use a polar solvent such as dimethyl formamide or dimethyl sulfoxide. Even these solvents are said to require the presence of a co-solvent. Mirviss, U.S. Pat. No. 3,523,926, describes the preparation of rubber vulcanizing agents by sulfurizing diolefins such as dicyclopentadiene. Mirviss uses 3–50 parts by weight sulfur per part of diolefin to prepare his vulcanizing agents which are hard solids.

Other relevant disclosures are Coleman, U.S. Pat. No. 3,632,566; Krespan, U.S. Pat. No. 3,088,935; Morris et al, U.S. Pat. No. 2,481,140 and Werntz, U.S. Pat. No. 2,338,829.

DESCRIPTION OF THE PREFERRED EMBODIMENTS

We have now found certain sulfurized products which are, at least in the preferred embodiments, very effective antioxidants in lubricating compositions such as crankcase lubricants. The sulfurized products are also useful for other purposes, for example as load-carriers in gear oil formulations.

Accordingly, in one aspect of the present invention there is provided a lubricating composition containing a major amount of lubricating oil and a minor amount of a sulfur-containing additive wherein said additive is a sulfur-containing norbornenyl compound having the general formula:

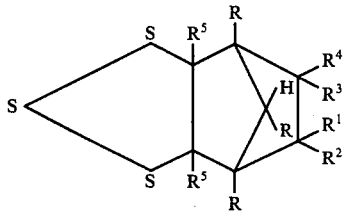

(A)

wherein:

(a) each of R, $R^2$ and $R^4$ when taken singly is a hydrogen atom, an alkyl group containing from 1 to about 15 carbon atoms, an aryl group containing from 6 to about 15 carbon atoms or a cycloalkyl group containing from 4 to about 10 carbon atoms;

(b) each of $R^1$ and $R^3$ when taken singly is a hydrogen atom, an alkyl group containing from 1 to about 15 carbon atoms; an aryl group containing from 6 to about 15 carbon atoms; an cycloalkyl group containing from 4 to about 10 carbon atoms or an alkenyl group containing from 2 to about 10 carbon atoms or $R^1$ and $R^3$ taken together form the group —CHY.CY=CY— in which Y is a hydrogen atom or a methyl group or $R^1$ together with $R^2$ form an alkylidene group containing from 1 to about 6 carbon atoms; and (c) $R^5$ is a hydrogen atom or an alkyl group containing from 1 to about 15 carbon atoms; or, wherein said additive is the oil-soluble sulfur-containing norbornenyl product resulting from sulfurizing a compound having the general formula:

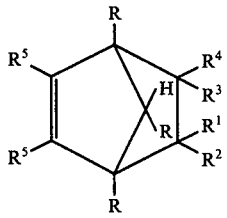

(B)

wherein R, $R^1$, $R^2$, $R^3$, $R^4$ and $R^5$ are as hereinbefore defined at a temperature of up to 180° C, said sulfurization being carried out in the absence of a solvent or in the presence of a non-polar solvent, the amount of sulfur reacted being 0.1–4 moles per mole of compound (B).

The foregoing compounds of formula (A) are known compounds and are described in U.S. Pat. No. 3,586,700, which also describes the preparation of the compounds by sulfurization of norbornenyl compounds to form the trithiolan derivatives depicted above. The sulfurization reaction of U.S. Pat. No. 3,586,700 is carried out necessarily in the presence of certain highly polar organic solvents.

However, in a very important aspect of the present invention there is provided a process for preparing an oil-soluble, metal-free, phosphorus-free substance suitable for use as a lubricant additive, which process comprises sulfurizing a compound having general formula (B) wherein, R, $R^1$, $R^2$, $R^3$, $R^4$, and $R^5$ are as hereinbefore defined, at a temperature of up to 180° C, said sulfurization being carried out in the absence of a solvent or in the presence of a non-polar solvent, and thereafter removing any oil-insoluble constituents from the resulting sulfurized product.

Examples of compounds which may be sulfurized in the process of the present invention are norbornene, 5-vinylnorbornene, dicyclopentadiene and methyl cyclopentadiene dimer of which dicyclopentadiene and methyl cyclopentadiene dimer are especially preferred.

If desired, the process of the present invention may be carried out in the presence of a catalyst of the type commonly used in sulfurization reactions, for example, tertiary amines such as triethylamine or pyridine, secondary amines such as di-isopropylamine, di-butylamine, and di-cyclohexylamine and primary amines such as cyclohexylamine and the $\gamma,\alpha$-dimethyl tertiary alkyl primary amines available commercially under such trade names as Primene JM-T and Primene 81-R. Other catalysts which may be used include:

2,5-Dimercapto-1,3,4-thiadiazole
2,5-Dimercapto-1,2,4-thiadiazole
2,5-Bis(t-octyldithio)-1,3,4-thiadiazole
Mercaptobenzothiazole
Sulfide ions, e.g., provided by sodium sulfide
Alkanolamines
Diphenyl guanidine
A Mixture of NaOH and mercaptobenzothiazole Peroxide such as the material marketed as tertiary butyl hydroperoxide consisting of about 70% of that peroxide together with about 30% di-t-butyl peroxide Particularly preferred catalysts are combinations of an amine and a thiadiazole derivative.

The amount of catalyst used is not critical, but normally will be about 0.1 to 20%, for example, from 2 to 10%, more preferably 0.1 to 10% and most preferably 0.3 to 2%, by weight based on the weight of the compound to be sulfurized.

The process of the present invention may also be carried out in the presence of a small amount, e.g., not more than 25 molar percent based on the compound to be sulfurized, of a solubilizing agent. Examples of solubilizing agents which may be used are:

Conjugated di- or poly-olefins such as alloocimene (1,5-dimethyl-2,4,6-octatriene)
Non-conjugated di- or poly-olefins such as 1,5,9-cyclododecatriene and 1,5-cyclooctadiene
Dialkyl maleates, preferably containing from 1 to 12, more preferably 4 to 8, carbon atoms in each alkyl group, e.g., dibutyl maleate
Alkenyl succinic acids or anhydrides thereof, preferably containing 8 to 12 carbon atoms in the alkenyl group, such as dodecenyl succinic acid
Alkyl mercaptans, preferably containing 8 to 12 carbon atoms such as t-dodecyl mercaptan
Polyisobutenyl succinimides
Mercaptobenzothiazole
Benzothiazole disulfide
Alkenoic acids, preferably containing from 8 to 18 carbon atoms such as oleic acid
Alkyl esters of alkenoic acids such as octyl methacrylate
Ethoxylated amines such as the material available commercially under the trade name Ethomeen T15
Dimerized alkenoic acids, preferably containing from 18 to 36 carbon atoms
Dicyclopentadiene hydrate
Alkanols, such as isodecanol.

Such solubilizing agents may assist in increasing the proportion of oil-soluble constituents in the product of the sulfurization reaction and, when used, will normally be present in an amount of 1 to 25, preferably 2 to 15, molar percent. Within this range it is preferred to use as small an amount of solubilizing agent as possible consistent with obtaining a reasonable amount of oil-soluble product (for example, not more than 25–30% by weight, preferably less, of the product should be oil-insoluble). The effectiveness of the solubilizing agent has been found to be dependent in part on the proportion of sulfur used in the sulfurization reaction, effectiveness decreasing with increasing proportions of sulfur used. Moreover, as exemplified hereinafter some solubilizing agents are more effective than others and solubilizing agents such as alloocimene, dibutyl maleate, dodecenyl succinic acid, t-dodecyl mercaptan, Ethomeen T15, oleic acid and mercaptobenzothiazole are most preferred.

In the process of the present invention the sulfur is used in an amount of from 0.1 to 4 moles per mole of compound to be sulfurized, with an amount of about 1 to 2 moles per mole of compound to be sulfurized being most preferred. Use of large amounts of sulfur in the process leads to the formation of a different product such as that described by Mirviss, U.S. Pat. No. 3,523,926. The sulfurization can be conveniently carried out by merely mixing the reactants, including any catalyst, and/or solubilizing agent used, and heating. Alternatively, the compound to be sulfurized can be added to hot sulfur. However, when using a relatively high amount of sulfur, i.e., an amount in the upper end of the preferred range, it is preferred to add the sulfur in portions over an initial period to the compound to be sulfurized maintained at the reaction temperature and then to continue maintaining the reaction temperature for a further period.

In general, a reaction temperature of at least 60° C is preferred, with at least 90° C or 100° C being most preferred for providing the preferred sulfurized materials as hereinbefore described. Also, a reaction temperature no greater than 160° C is preferred. Sulfurization is normally completed in from 0.5 to 24 hours depending on the reaction temperature. At the optimum temperature of about 110° C to 140° C a reaction time of about 2 hours is generally found to be most satisfactory, the co-reactants either being mixed and heated for 2 hours or the sulfur being added to the compound to be sulfurized in portions over, for example, 1 hour at 120° C and this temperature then being maintained for a further hour.

The sulfurization may, if desired, be carried out in an inert atmosphere such as a nitrogen blanket. The pressure at which the sulfurization is carried out is not critical, but is preferably not reduced to a level at which significant amounts of the compound being sulfurized are lost from the reaction system by distillation.

Although it is preferred to carry out the sulfurization in the absence of a solvent it is also possible to carry out the reaction in the presence of a non-polar solvent, examples of the latter being petroleum ether, toluene, benzene, xylene and mineral oil (especially a mineral lubricating oil).

After completion of the sulfurization any oil-insoluble constituent of the product may be removed by any convenient method using well-known techniques such as solvent extraction or dissolving in oil followed by filtration. However, if the reaction is carried out under careful control at the optimum conditions the whole product is frequently oil-soluble and removal of oil-insoluble constituents is not necessary. Accordingly, reference made herein to removal of oil-insoluble constituents is to be understood to mean, unless the context denotes otherwise, removal of oil-insoluble constituents if, and as, necessary.

A preferred technique for removal of oil-insoluble by-products is to initially strip off excess olefin which would otherwise solubilize the insoluble component and to then add excess petroleum ether to precipitate an insoluble phase which can be removed. The petroleum ether is then stripped off to yield a totally oil-soluble product.

In a preferred embodiment of the invention dicyclopentadiene is sulfurized using 2 moles of sulfur per mole of dicyclopentadiene at a temperature of about 120° C using diisopropylamine and 2,5-bis(t-octyl-dithio)-1,3,4-thiadiazole as catalysts, and, optionally, one of the most preferred solubilizes listed above.

In a further aspect the present invention also includes the oil-soluble, metal-free, phosphorus-free products prepared by the process of the present invention.

It is to be understood that as with all chemical substances purity, in an absolute sense, is impossible to achieve and the sulfurized olefins of the present invention may contain, as a result of contaminants present in the starting materials, a trace of metal and/or phosphorus. However, such traces should be present in such minute quantities as to be of no practical significance and it is to be understood that the starting materials should not be grossly contaminated with metal and/or phosphorus compounds. However, commercially available grades of starting materials are normally completely adequate in this respect and any contamination arising therefrom is far below any level of practical significance.

The products of the process of the present invention preferably contain from about 15 to 40% by weight of sulfur and reaction conditions and proportions of co-reactants may be adjusted in order to vary the sulfur content of the product. Further, the products of the process of the present invention are believed to contain substantial amounts of the trithiolan derivatives hereinbefore depicted in formula (A).

Preferably, the lubricating compositions of the present invention comprise from 0.1% to 10%, more preferably 0.25% to 5%, by weight of the oil-soluble, metal-free, phosphorus-free products and/or compounds of foregoing formula (A) and the lubricating oil may be any of the well-known mineral or synthetic oils of appropriate viscosity characteristics.

It will be understood that the lubricating compositions of the present invention may also contain, if desired, conventional lubricant additives such as ancillary antioxidants and anti-wear additives (preferably ashless), corrosion inhibitors, dispersants, particularly dispersants of the succinimide type, detergents, thickeners, pour-point depressants and viscosity index improvers. A particularly useful additive to be used in conjunction with the additives of the present invention is benzotriazole which has been found to reduce lacquer formation and improve the appearance of bearings in test engines lubricated with compositions of the present invention. The benzotriazole may, if desired, be incorporated prior to the sulfurization reaction of the present invention or after sulfurization but either before or after the removal of any oil-insoluble consituents.

The additives of the present invention may also be conveniently prepared as a concentrate consisting of a concentrated solution of a major amount of the additives and a minor amount of mineral oil, or as an additive package consisting of a concentrated solution in mineral oil of a major amount of a combination of the additives with one or more conventional additives. Such concentrates and packages are frequently very convenient forms in which to handle and transport additives and are diluted with further quantities of oil, and optionally blended with further additives, before use.

Hence, in accordance with another aspect of the invention, there is provided a solution comprising a major amount of one or more compounds having the formula (A) or one or more of the oil-soluble metal-free, phosphorus-free products of the process of the invention and a minor amount of a lubricating oil. One or more conventional additives may be combined with the compounds of formula (A) or the oil-soluble, metal-free, phosphorus-free products.

The present invention will now be illustrated with reference to the following examples:

EXAMPLE 1

A mixture of dicyclopentadiene (264 g, 2.0 m) and triethylamine catalyst (13.2 g) was added dropwise over a period of 1 hour to sulfur (128 g, 4.0 m) maintained at a temperature of about 140° C. About half-way through this addition an exotherm to 155° C was noticed and this was quickly controlled by air blast cooling and no further problems were encountered during the remainder of the addition. After completion of the addition the resulting reaction mixture was maintained at 140°–145° C for a further 1 hour, whereafter about 0.2 g hydroquinone was added to the resulting crude product.

The crude product was stripped under high vacuum (0.2 mm Hg) to a base temperature of 160° C (internal temperature 140° C) to yield 33.0 g (8.4% by weight) of a distillate (predominantly unreacted dicyclopentadiene). The residue was placed in a 1 liter separating funnel together with an amount of petroleum ether (B.Pt. 62°–68° C) sufficient to substantially fill the funnel resulting in a viscous, oily, petroleum ether-insoluble layer (yield 212.1 g, 54.1% by weight) and a petroleum ether layer. The latter was separated and the petroleum ether stripped off to yield 149.2 g (38.2% by weight) of the final, oil-soluble product containing 32.5% sulfur.

EXAMPLE 2

Dicyclopentadiene (264 g, 2.0m) was added dropwise over a period of 40 minutes to sulfur (64 g, 2.0 m) at 145° C. The resulting reaction mixture was maintained at 145° C for a further hour and about 0.2 g hydroquinone added to the resulting crude product which was cooled and then stripped under high vacuum to a base temperature of 140° C to yield 180 g (55.0% by weight) of unreacted dicyclopentadiene as distillate. The residue was worked up in the same manner as in Example 1 to yield 66.3 g (20.2% by weight) of soluble material containing 31.0% sulfur and 18.9 g (5.8% by weight) of oil-insoluble product.

EXAMPLE 3

Dicyclopentadiene (264 g, 2.0 m), sulfur (64 g, 2.0 m) and triethylamine catalyst (13.2 g) were mixed and heated to 145° C for 2 hours. The resulting crude product was cooled slightly and about 0.2 g hydroquinone added thereto. The crude product was then cooled and worked up in the same manner as in Example 2 to yield 116.7 g (35.6% by weight) distillate, 53.2 g (16.2% by weight) insoluble material and 155.0 g (47.4% by weight) oil-soluble product containing 27.7% sulfur.

EXAMPLE 4

Dicyclopentadiene (238 g, 1.8 m), sulfur (64 g, 2.0 m), triethylamine catalyst (14.2 g) and, as solubilizing agent, dibutyl maleate (45.6 g, 0.2 m) were mixed and heated to 140°–150° C for 2 hours. Hydroquinone (about 0.2 g) was added to the crude product which was then stripped to 120° C at 0.2 mm Hg to yield 83 g (23.9% by weight) distillate. The residue was worked up in the same manner as in Example 1 to yield about 1 g insoluble material and 250.3 g (72.0% by weight) oil-soluble product containing 24.7% sulfur.

EXAMPLE 5 TO 14

Further preparations were carried out in the manner of Example 4 and details thereof are given in the following Table 1.

EXAMPLE 15

A mixture of dicyclopentadiene (178 g, 1.35 m), dibutyl maleate (34.2 g, 0.15 m) and triethylamine (10.6 g) was heated to 140° C and sulfur (72 g, 2.25 m) was added thereto over a period of 50 minutes during which the temperature was maintained at 140° C. The temperature was maintained at 140° C for a further 70 minutes, whereafter 0.2 g hydroquinone was added and the crude product stripped to 150° C (140° C internal temperature) at 0.1 mm Hg to yield 57 g (20.1% by weight) distillate. The residue was worked up in the same manner as in Example 1 to yield 32.6 g (11.5% by weight) insoluble material and 184.3 g (64.8% by weight) oil-soluble product containing 28.4% sulfur.

EXAMPLE 16 to 30

Further preparations were carried out in the manner of Example 15 and details thereof are given in the following Table 2.

EXAMPLE 31

Sulfur (144 g, 4.5 m) was added incrementally over a period of 1 hour to a mixture of dicyclopentadiene (356 g, 2.7 m), dibutyl maleate (68.4 g, 0.3 m), triethylamine (21.2 g) and 2,5-dimercapto-1,3,4-thiadiazole (4.2 g) at a temperature of 160° C. The reaction mixture was then maintained at 160° C for a further hour, whereafter it was stripped up to 110° C on a rotary evaporator under water pump vacuum (about 30 mm Hg) to yield 2 g of distillate (excess dicyclopentadiene). The product was extracted with three times its volume of petroleum ether (boiling point 62°–68° C) yielding 75.1 g (13.7%) of insoluble material and petroleum ether stripped off the extract to yield 472.3 g (83%) of soluble material containing 25.0% sulfur.

EXAMPLE 32

Example 31 was repeated except in that the reaction temperature was kept at 90° C and extraction with petroleum ether was not carried out to yield 184 g (50.4%) excess cyclopentadiene, no insoluble material and 386 g (68.0%) soluble product containing 35.5% S.

EXAMPLE 33

Example 32 was repeated except in that the reaction temperature was kept at 120° C to yield 120 g excess cyclopentadiene, no insoluble material and 455 g (80%) soluble product containing 31.9% S.

EXAMPLE 34 TO 42

Further preparations were carried out in the manner of Example 33 and details thereof are given in the following Table 3.

EXAMPLE 43

Sulfur (172.8 g, 5.4 m) was added incrementally over 1½ hours, at a temperature of 90° C, to a mixture of dicyclopentadiene (356 g, 2.7 m), dibutyl maleate (68.4 g, 0.3 m), di-isopropylamine (5 g) and sodium sulfide powder (5 g). The reaction mixture was then stirred for a further 2 hours with the reaction temperature maintained in the range of 85°–90° C. The resulting product was then filtered and stripped to 120° C under water pump vacuum to yield 83 g distillate (excess dicyclopentadiene). The stripped product (462 g) was not fully oil soluble and was therefore boiled with 1¼ liters petroleum ether to yield 350 g (59%) of soluble product containing 33.8% S.

EXAMPLE 44

Dicyclopentadiene (356 g, 2.7 m), dibutyl maleate (68.4 g, 0.3 m), di-isopropylamine (4 g) and 2,5-bis(t-octyldithio)-1,3,4-thiadiazole were dissolved in toluene (500 ml) and sulfur (172.8 g, 5.4 m) added thereto incrementally over 1 hour while maintaining a reaction temperature of 120° C. The reaction mixture was then stirred for a further 1 hour at 120° C and vacuum stripped (removing toluene at 100° C and excess dicyclopentadiene at 120° C) to yield 461 g (76.7%) soluble product containing 34.1% S.

EXAMPLE 45

Example 44 was repeated using 500 ml petroleum ether (boiling point 80°–100° C) in place of the toluene. The reaction temperature was maintained in the range of 100°–110° C throughout due to the volatility of the solvent. In this way was obtained 469.9 g (78.2%) of soluble product containing 36.2% S.

EXAMPLE 46

Dicyclopentadiene (178 g, 1.35 m), dibutyl maleate (34.2 g, 0.15 m), di-isopropylamine (2 g) and 2,5-bis(octyldithio)-1,3,4-thiadiazole (2 g) were dissolved in 200 g of high viscosity index 100 Solvent Neutral mineral oil. Sulfur (86.4 g, 2.7 m) was added incrementally over 1 hour at 110°-120° C and the reaction temperature maintained at 120° C for a further 1 hour. The product was vacuum stripped and filtered to yield 461 g (92.4%) of oil-soluble product containing 19.0% S.

EXAMPLE 47

Dicyclopentadiene (178 g, 1.35 m), dibutyl maleate (34.2 g, 0.15 m), di-isopropylamine (2 g) were dissolved in 250 ml toluene. Sulfur (129.6 g, 4.05 m) was added thereto over ½ hour at 110°-120° C and the resulting mixture stirred for a further 1½ hours at 120° C. After vacuum stripping and filtration 300 g (88%) of product containing 39.9% S was obtained. This gave a hazy solution in mineral oil indicating the presence of a very low level of insoluble material.

EXAMPLE 48

Example 44 was repeated except in that 172.8 g (5.4 m) sulfur was used and a reaction temperature of 110° C was used. There was obtained 191.4 g (49.9%) soluble product and 138.6 g (36.1%) insoluble product.

EXAMPLE 49

5-Vinylnorbornene (84 g, 0.7 m), di-isopropylamine (4.0 g) and 2,5-bis(t-octyldithio)-1,3,4-thiadiazole (0.8 g) were mixed, heated to 130° C and sulfur (22.4 g, 0.7 m) added thereto portionwise over 1 hour. The temperature was maintained at 130° C for a further 1 hour and the reaction mixture was stripped to 100° C at 0.1 mm Hg to remove 20.8 g (19.6%) unreacted 5-vinylnorbornene. The product was extracted with 250 ml petroleum ether (boiling point 62°-68° C) and filtered to remove a small quantity of insoluble material. The petroleum ether was stripped from the extract to yield 51 g (48%) of soluble product.

In some of the foregoing examples (1 to 5, 9, 11 and 18) a small quantity of hydroquinone was added to the crude product of the sulfurization reaction since it was thought that the reaction proceeded by a free radical mechanism and that continuation of free radical reaction during working up of the crude product could lead to some degradation. The hydroquinone was therefore used to suppress free radical reaction. However, subsequent experience indicated that the use of hydroquinone did not materially improve the additive preparation.

As mentioned earlier, Mirviss describes a process of sulfurizing diolefins using 3-50 parts by weight sulfur per part of diolefin. This differs from the present process which uses only 0.1-4 moles of sulfur per mole of norbornenyl compound. For example, 4 moles of sulfur per mole of dicyclopentadiene is less than one part by weight sulfur per part by weight dicyclopentadiene. As the following example shows, the products obtained following the Mirviss process are different than the products made following the present process.

EXAMPLE 50

In a reaction flask was placed a mixture of 66 g (0.5 m) dicyclopentadiene, 182 g (6 m) sulfur and 5 g tributylamine. The mixture was heated to 140° C and an exothermic reaction occurred causing rapid frothing and solidification of the reaction mixture in the flask and condenser. The product was a black brittle solid.

Various products of the foregoing examples were tested to determine their suitability as lubricant additives. Petter Wl Engine tests were carried out by the Institute of Petroleum's method IP 176/69 using an ashless blend consisting of a commercially available succinimide-type dispersant, a secondary aromatic amine antioxidant and a combination of corrosion inhibitors together with 1.0% by weight of the test additive all dissolved in a 500 Solvent Neutral mineral oil. Bearing weight losses after a 36 hour test were measured and were as follows:

| Test Additive | | Bearing Weight Loss (mg) |
|---|---|---|
| Product of Example | 1 | 9 |
| " | 3 | 17.4 |
| " | 4 | 9 |
| " | 5 | 75 |
| " | 6 | 8 |
| " | 8 | 7 |
| " | 11 | 5 |
| " | 12 | 5 |
| Product of Example | 14 | 10 |
| " | 15 | 12 |
| " | 16 | 8 |
| " | 19 | 8 |
| " | 21 | 3 |
| " | 22 | 17 |
| " | 24 | 19 |
| " | 30 | 9 |
| Product of Example | 37 | 13 |

Extended Wl tests were carried out for typical test additives (in the same blends) by the same method except that oil samples removed from time to time were not replaced. Bearing Weight Losses were as follows:

| Test Additive | Bearing Weight Loss (mg) | | |
|---|---|---|---|
| | 36 hrs | 72 hrs | 108 hrs |
| Product of Example 29 | 10 | 19 | 28 |
| Product of Example 30 | 22 | 28 | 51 |
| Product of Example 42 | 10 | 17 | 20 |

In comparison, a typical fully-formulated commercially available 10W/50 oil containing a zinc dialkyl dithiophosphate as antioxidant, a succinimide-type dispersant, a metal sulphonate detergent, a polymethacrylate viscosity index improver and a combination of corrosion inhibitors gave bearing weight losses in this test of 15mg, 27mg and 68mg at 36, 72 and 108 hours, respectively.

Load carrying properties were determined using the Timken OK load test according to the IP240/69T method (except in that results are quoted in lbs). The test blends consisted of test additive dissolved in 150 Solvent Neutral mineral oil, the former being in amount to provide 0.3% by weight sulfur in the test blend and the results were as follows:

| Test Additive | | Timken OK Load (lbs) |
|---|---|---|
| None (base oil only) | | 12 |
| Product of Example | 5 | 30 |
| " | 6 | 45 |
| " | 8 | 50 |
| " | 18 | 45 |
| " | 19 | 45 |
| " | 25 | 40 |
| " | 35 | 40 |

In comparison, commercially available zinc dialkyl dithiophosphates usually give Timken OK loads of 35-40 lbs in this test.

Rotary Bomb Tests carried out by the IP229/68T method on blends consisting of 2.0% by weight test additive dissolved in 500 Solvent Neutral mineral oil gave the following induction periods:

| Test Additive | | Induction Period (minutes) |
|---|---|---|
| None (base oil only) | | 35 |
| Product of Example | 5 | 99 |
| " | 11 | 178 |
| " | 49 | 150 |
| " | 1 | 190 (25 p.s.i. loss) |
| " | 19 | 216 (25 p.s.i. loss) |
| " | 23 | 112 (25 p.s.i. loss) |

Copper strip tests were carried out by the ASTM method except in that a temperature of 120° C was used. The blends tested consisted of sufficient test additive to provide a blend containing 0.15% S dissolved in a 500 Solvent Neutral or a 150 Solvent Neutral mineral oil. ASTM ratings after 3 hours were as follows:

| Test Additive | | Rating |
|---|---|---|
| None (base oil only) | | 2b |
| Product of Example | 1 | 2a |
| " | 4 | 2e |
| " | 5 | 2e |
| " | 6 | 1b |
| " | 8 | 1b |
| " | 11 | 2c |
| " | 12 | 2c |
| " | 14 | 2b/c |
| Product of Example | 15 | 1b/3a |
| " | 16 | 3b |
| " | 18 | 2e |
| " | 19 | 2e |
| " | 21 | 1b |
| " | 22 | 2e |
| " | 23 | 3b |
| " | 24 | 1b |
| Product of Example | 30 | 1b |
| " | 33 | 1b |
| " | 37 | 2c/3a |
| " | 42 | 1b |

-continued

| Test Additive | | Rating |
|---|---|---|
| " | 49 | 2a |

From the foregoing test results it can be seen that the additives of the present invention impart antioxidant properties (Rotary Bomb Test) and yet have a low level of corrosiveness (Copper Strip Test) despite the high sulfur content. Furthermore, in the standard tests the additives demonstrate load carrying abilities (Timken OK Load Test) and test engine performance (Petter Wl Tests) in fully formulated blends similar to those exhibited by the zinc dialkyl dithiophosphates normally used in premium grade crankcase lubricants.

The suitability of the additives of the present invention for use in gear oil formulations was determined by use of the S.A.E. tests in which two parallel shafts are provided with interengaging surfaces lubricated with the test blend and are driven at speeds in a ratio of 14.6:1. After a short running period the load on the interengaging surface is incrementally increased until scuffing occurs. With a blend consisting of an S.A.E. 90 base oil, 4.5% by weight of an additive in accordance with the present invention (containing 30.3% S) and 0.5% by weight di-isopropyl phosphite scuffing resulted in 245 lb and 230 lb (duplicate tests) at a drive shaft speed of 1,000 r.p.m. Under the same condition, a blend consisting of the same base oil containing 4.5% by weight sulfurized isobutylene (a commercially available gear oil additive containing 45% S) and 0.5% by weight di-isopropyl phosphite, resulting in scuffing at 265 lb and 310 lb. Thus, the blend containing the additive according to the present invention produced similar test results even though the sulfur content was substantially less than in the comparison blend.

TABLE 1

Examples 5 to 10 (Columns 1 to 5 inclusive)

| Example No. | Dicyclo-pentadiene | Solubilizing Agent | Sulfur | Catalyst | Reaction Conditions |
|---|---|---|---|---|---|
| 5 | 264g 2.0m | None | 64g 2.0m | Tetramethyl thiuram di-sulfide 13.2g | 2 hrs at 140° C |
| 6 | 238g 1.8m | Dibutyl Maleate 45.6g, 0.2m | 64g 2.0m | Triethylamine 14.2g DMTZ 2.8g | 2 hrs at 140°C* |
| 7 | 264g 2.0m | None | 64g 2.0m | Triethylamine 13.2g | 2 hrs at 140° C |
| 8 | 238g 1.8m | Dodecenyl Succinic Anhydride 47.6g, 0.18m | 64g 2.0m | Triethylamine 14.3g | 2 hrs at 140° C* |
| 9 | 198g 1.5m | Cyclododeca-1,5,9-triene 82g, 0.5m | 64g 2.0m | Triethylamine 14.0g | 2 hrs at 140° C |
| 10 | 238g 1.8m | Octyl Methacrylate 39.6g, 0.2m | 64g 2.0m | Triethylamine 13.9g | 2 hrs at 140° C |
| 11 | 238g 1.8m | Cyclododeca-1,5,9-triene 32.8g, 0.2m | 64g 2.0m | Triethylamine 13.5g | 2 hrs. at 140° C |
| 12 | 238g 1.8m | Alloocimene 27.2g, 0.2m | 64g 2.0m | Triethylamine 13.2g | 2 hrs at 140° C |
| 13 | 238g 1.8m | Cyclododeca-1,5,9-triene 32.4g, 0.2m | 64g 2.0m | Triethylamine | 2 hrs at 140° C |
| 14 | 238g 1.8m | Cyclododeca-1,5,9-triene 32.4g, 0.2m 0.1% of 70% t-butyl hydro-peroxide | 64g 2.0m | Triethylamine 13.5g | 2 hrs at 140° C |

Examples 5 to 14 (Columns 6 to 8 inclusive)

| Stripping Conditions | Yield |
|---|---|

TABLE 1-continued

| Example No. | (removing unreacted dicyclopentadiene) | Distillate Weight (g) | Distillate % | Insoluble Weight (g) | Insoluble % | Soluble Weight (g) | Soluble % | %S in soluble product |
|---|---|---|---|---|---|---|---|---|
| 5 | 110° C at 0.1mm Hg | 125 | 38.2 | 75.6 | 23.0 | 124 | 37.9 | 32.5 |
| 6 | 130° C at 0.1mm Hg | 123 | 35.4 | 0 | 0 | 213 | 61.3 | 28.6 |
| 7 | 140° C at 0.1mm Hg | 116 | 35.4 | 52.7 | 16.1 | 141.7 | 43.2 | 28.5 |
| 8 | 140° C at 0.1mm Hg | 106 | 30.3 | 0 | 0 | 236.5 | 67.6 | 26.5 |
| 9 | 120° C at 0.1mm Hg | 113.5 | 32.9 | 20.0 | 5.8 | 207.1 | 60.2 | 26.8 |
| 10 | 145° C at 0.1mm Hg | 124 | 36.3 | 25.5 | 7.5 | 172.3 | 50.4 | 27.2 |
| 11 | 110° C at 0.1mm Hg | 108.4 | 32.2 | 37.0 | 11.0 | 182.3 | 54.5 | 26.9 |
| 12 | 120° C at 0.1mm Hg | 95.1 | 29.0 | 2.3 | 0.7 | 229 | 69.8 | 27.3 |
| 13 | 115° C at 0.1mm Hg | 146 | 43.7 | 68.1 | 20.4 | 98.5 | 29.5 | 31.3 |
| 14 | 105° C at 0.1mm Hg | 131 | 39.2 | 40 | 12.0 | 140.7 | 42.1 | 29.6 |

*On initial heating a sharp exotherm was noticed at an internal temperature of 100–110° C. The exotherm raised temperature to about 160° C. The temperature then settled back to 140° C and thereafter the reaction proceeded smoothly for 2 hours.

TABLE 2

Examples 16 to 21 (Columns 1 to 5 inclusive)

| Example No. | Dicyclopentadiene | Solubilizing Agent | Sulfur | Catalyst | Reaction Conditions |
|---|---|---|---|---|---|
| 16 | 158.3g 1.2m | Alloocimene 40.8g, 0.3m | 96g 3.0m | Triethylamine 10.0g | Addition of S over 1-½ hrs at 140° C + further ½ hr at 140° C |
| 17 | 198g 1.5m | None | 72g 2.25m | Triethylamine 9.9g | Addition of S over 1 hr at 140° C + further 1 hr at 140° C |
| 18 | 178g 1.35m | Alloocimene 20.4g, 0.15m | 72g 2.25m | Triethylamine 9.9g | Addition of S over ¾ hr at 140° C + further 1-½ hrs at 140° C |
| 19 | 178g 1.35m | t-Dodecyl Mercaptan 32.5g, 0.15m | 72g 2.25m | Triethylamine 10.5g | Addition of S over 70 mins at 140° C + further 50 mins at 140° C |
| 20 | 178g 1.35m | Oleic acid 42.3g, 0.15m | 72g 2.25m | Triethylamine 11.0g | Addition of S over 1 hr at 140° C + further 1 hr at 140° C |
| 21 | 178g 1.35m | Mercapto-benzothiazole 25.0g, 0.15m | 72g 2.25m | Triethylamine 10.1g | Addition of S over 70 mins at 140° C + further 50 mins at 140–150° C |

Examples 22 to 26 (Columns 1 to 5 inclusive)

| Example No. | Dicyclopentadiene | Solubilizing Agent | Sulfur | Catalyst | Reaction Conditions |
|---|---|---|---|---|---|
| 22 | 178g 1.35m | Ethomeen* T 15 72.4g | 72g 2.25m | Triethylamine 12.5g | Addition of S over 70 mins at 140° C + further 50 mins at 140–150° C |
| 23 | 216g** 1.35m | Dibutyl Maleate 34.2g, 0.15m | 72 g 2.25m | Triethylamine 12.5g | Addition of S over 1 hr at 140° C + further 1 hr at 140° C |
| 24 | 178g 1.35m | t-Dodecyl Mercaptan 30.3g, 0.15m | 72g 2.25m | Triethylamine 10.5g 2,5-Dimercapto-1,3,4-thiadiazole 2.4g | Addition of S over 1 hr at 140° C + further 1 hr at 140° C |
| 25 | 356g 2.7m | Dibutyl maleate 68.4g, 0.3m | 144g 4.5m | Triethylamine 21.2g + 2,5-dimercapto-1,3,4-thiadiazole 4.2g | Addition of S over 1-½ hr at 140° C + further ¾ hr at 140° C |
| 26 | 178g 1.35m | Dicyclopentadiene hydrate 22.5g, 0.15m | 72g 2.25m | Triethylamine 10.0g | Addition of S over 1-½ hr at 140° C + further ¾ hr at 140° C |

*Ethomeen T 15 is a commercially available ethoxylated tallow amine of average molecular weight 482 and containing an average of 5 ethylene oxide residues per molecule.
**Methylcyclopentadiene dimer used in place of dicyclopentadiene.

Examples 27 to 30 (Columns 1 to 5 inclusive)

| Example No. | Dicyclopentadiene | Solubilizing Agent | Sulfur | Catalyst | Reaction Conditions |
|---|---|---|---|---|---|
| 27 | 178g | Isodecanol | 72g | Triethylamine | Addition of S over |

TABLE 2-continued

| | | | | | |
|---|---|---|---|---|---|
| | 1.35m | 23.7g, 0.15m | 2.25m | 10.1g | 1-¼ hr at 140° C + further ¾ hr at 140° C |
| 28 | 187.9g 1.425m | Dimer acid 42.8g, 0.075m | 72g 2.25m | Triethylamine 11.6g | Addition of S over 1-¼ hr at 140° C + further ¾ hr at 140° C |
| 29*** | 356g 2.7m | Dodecenyl succinic anhydride 79.8g, 0.3m | 144g 4.5m | Triethylamine 22.8g | Addition of S over 1-¼ hr at 140° C + further ¾ hr at 140° C |
| 30*** | 178g 1.35m | Dibutyl maleate 34.2g, 0.15m | 72g 2.25m | Triethylamine 10.6g | Addition of S over 1-¼ hr at 140° C + ¾ hr at 140° C |

***Benzotriazole (4.4g and 2.2g in Examples 29 and 30 respectively) present during sulfurization.

Examples 16 to 24 (Columns 6 to 8 inclusive)

| Example No. | Stripping Conditions (removing unreacted dicyclopentadiene) | Yield: Distillate Wt. (g) | Distillate % | Insoluble Wt. (g) | Insoluble % | Soluble Wt. (g) | Soluble % | %S in soluble product |
|---|---|---|---|---|---|---|---|---|
| 16 | 145° C at 0.1mm Hg | 5 | 1.6 | 133.4 | 45.3 | 138 | 46.8 | 28.4 |
| 17 | 140° C at 0.1mm Hg | 43 | 15.9 | 86.0 | 31.9 | 125.5 | 46.5 | 28.0 |
| 18 | 130° C at 0.1mm Hg | 32 | 11.8 | 47.5 | 17.6 | 172.8 | 63.8 | 26.8 |
| 19 | 150° C at 0.2mm Hg | 21 | 7.4 | 25 | 8.8 | 213.9 | 75.6 | 26.7 |
| 20 | 140° C at 0.1mm Hg | 32 | 10.9 | 40.4 | 13.8 | 198 | 67.8 | 22.2 |
| 21 | 143° C at 0.1mm Hg | 35 | 12.7 | 34.4 | 12.5 | 198.3 | 72.1 | 32.2 |
| 22 | 150° C at 0.1mm Hg | 23 | 7.2 | 21.1 | 6.6 | 256.3 | 79.6 | 22.0 |
| 23 | 140° C at 0.1mm Hg | 45 | 14 | 0 | 0 | 258.7 | 80.4 | 24.6 |
| 24 | 140° C at 0.1mm Hg | 38.0 | 13.5 | 11.2 | 4.0 | 220 | 78.1 | 29.9 |

Examples 25 to 30 (Columns 6 to 8 inclusive)

| Example No. | Stripping Conditions (removing unreacted dicyclopentadiene | Yield: Distillate Wt. (g) | Distillate % | Insoluble Wt. (g) | Insoluble % | Soluble Wt. (g) | Soluble % | %S in soluble product |
|---|---|---|---|---|---|---|---|---|
| 25 | 140° C at 0.1mm Hg | 106.3 | 18.7 | 0 | 0 | 431 | 76.0 | 30.3 |
| 26 | 150° C at 0.1mm Hg | 42.0 | 15.4 | 83.5 | 30.7 | 137 | 50.4 | 27.7 |
| 27 | 145° C at 0.1mm Hg | 50 | 18.2 | 92.5 | 33.6 | 129.4 | 47.3 | 27.4 |
| 28 | 145° C at 0.1mm Hg | 28 | 9.2 | 67 | 22.1 | 195 | 58.5 | 21.8 |
| 29 | 140° C at 0.1mm Hg | 41 | 7.1 | 53.2 | 9.2 | 483 | 83.4 | 24.7 |
| 30 | 140° C at 0.1mm Hg | 32 | 11.3 | 24.1 | 8.5 | 221.6 | 78 | 26.1 |

TABLE 3

Examples 34 to 38 (Columns 1 to 5 inclusive)

| Example No. | Dicyclopentadiene | Solubilizing Agent | Sulfur | Catalyst | Reaction Conditions |
|---|---|---|---|---|---|
| 34 | 356g 2.7m | Dibutyl Maleate 12.5g | 172.8g 5.4m | Cyclohexylamine 7.5g 2,5-Dimercapto-1,3,4-thiadiazole 3.7g | Addition of S over 1 hr at 120° C + further 1 hr at 120° C |
| 35** | 356g 2.7m | Dibutyl Maleate 12.5g | 172.8g 5.4m | Primene 81R 15g 2,5-Dimercapto-1,3,4-thiadiazole 3.7g | Addition of S over 1 hr at 120° C + further 1 hr at 120° C |
| 36 | 356g 2.7m | None | 172.8g 5.4m | Di-n-butylamine 6.5g 2,5-Dimercapto-1,3,4-thiadiazole 3.7g | Addition of S over 1 hr at 120° C + further 1 hr at 120° C |
| 37 | 356g 2.7m | Dibutyl Maleate 12.5g | 172.8g 5.4m | 2,5-Dimercapto-1,3,4-thiadiazole 3.7g Di-isopropylamine 7.6g | Addition of S over 1 hr at 120° C + further 1 hr at 120° C |
| 38 | 356g 2.7m | Dibutyl Maleate 12.5g | 172.8g 5.4m | Triethylamine 5.0g 2,5-Dimercapto-1,3,4-thiadiazole | Addition of S over 1 hr at 120° C + further 1 hr at |

TABLE 3-continued

| | | | | | |
|---|---|---|---|---|---|
| | | | 3.7g | | |

**Benzotriazole (3.7g in Example 35 and 4.0g in each of Examples 39 and 41 present during sulfurization.

Examples 39 to 42 (Columns 1 to 5 inclusive)

| Example No. | Dicyclo-pentadiene | Solubilizing Agent | Sulfur | Catalyst | Reaction Conditions |
|---|---|---|---|---|---|
| 39* | 356g 2.7m | Dibutyl Maleate 68.4g, 0.3m | 172.8g 5.4m | Di-isopropylamine 7.5g 2,5-bis(t-octyl-dithio)-1,3,4-thiadiazole 4.0g | Addition of S over 1 hr at 120° C + further 1 hr at 120° C |
| 40 | 356g 2.7m | Dibutyl Maleate 68.4g, 0.3m | 172.8g 5.4m | Di-isopropylamine 4.0g 2,5-bis(t-octyl-dithio)-1,3,4-thiadiazole 4.0g | Addition of S over 1 hr at 120° C + further 1 hr at 120° C |
| 41** | 356g 2.7m | None | 172.8g 5.4m | Di-isopropylamine 4.0g 2,5-bis(t-octyl-dithio)-1,3,4-thiadiazole 4.0g | Addition of S over 1 hr at 120° C + further 1 hr at 120° C |
| 42 | 356g 2.7m | Dibutyl Maleate 68.4g, 0.3m | 172.8g 5.4m | Di-isopropylamine 4.0g 2,5-bis(t-octyl-dithio)-1,3,4-thiadiazole 4.0g | Addition of S over 1 hr at 120° C + further ½ hr at 120° C + addition of 4.0g Benzotriazole + further ½ hr at 120° C |

*2,5-Dimercapto-1,3,4-thiadiazole (3.7g) formed in situ by heating carbon disulfide (3.8g) and hydrazine hydrate (1.25g) in the dicyclopentadiene for ½ hour at 50° C. Thereafter the di-isopropylamine was added and sulfurization carried out.
**Benzotriazole (3.7g) in Ex. 35 and 4.0g in each of Ex. 39 and 41 present during sulfurization.

Examples 34 to 42 (Columns 6 to 8 inclusive)

| Example No. | Stripping Conditions (removing unreacted dicyclo-pentadiene | Yield: Distillate Wt. (g) | Distillate % | Insoluble Wt. (g) | Insoluble % | Soluble Wt. (g) | Soluble % | % S in soluble product |
|---|---|---|---|---|---|---|---|---|
| 34 | 110° C at about 30mm | 94 | 26.4 | — | <0.1 | 423 | 79 | — |
| 35 | 110° C at 20mm | 88 | 24.7 | — | <0.1 | 467 | 83.4 | 37.1 |
| 36 | 110° C at about 30mm | 70 | 19.7 | — | <0.1 | 424.2 | 78 | — |
| 37 | 110° C at about 30mm | 91 | 25.6 | — | <0.1 | 429.3 | 79.5 | 38.4 |
| 38 | 110° C at about 30mm | 82 | 23 | — | <0.1 | 451 | 83.3 | 36.3 |
| 39 | 110° C at about 30mm | 94 | 26.4 | — | <0.1 | 480.1 | 78.9 | 33.2 |
| 40 | 110° C at about 30mm | 85 | 23.9 | — | <0.1 | 484.5 | 80.3 | 34.4 |
| 41 | 110° C at about 30mm | — | — | — | <0.1 | 405.1 | 75.4 | — |
| 42 | 120° C at about 30mm Hg | 115 | 32.3 | — | <0.1 | 426 | 70.04 | 34.5 |

We claim:

1. A process for preparing a normally liquid, oil-soluble, metal-free, phosphorus-free substance by reacting sulfur with a compound selected from dimers of cyclopentadiene, methylcyclopentadiene and mixtures thereof, said by reacting being carried out in the absence of a solvent or in the presence of a non-polar solvent, the amount of sulfur reacted being 0.1–4 moles per mole of said compound.

2. A process according to claim 1 wherein said reacting with sulfur is carried out at a temperature of from 60° to 180° C.

3. A process according to claim 1 wherein said reacting with sulfur is carried out at a temperature of from 90° to 160° C.

4. A process according to claim 1 wherein said reacting with sulfur is carried out at a temperature of from 110° to 140° C.

5. A process according to claim 1 wherein said reacting with sulfur is carried out in the absence of a solvent.

6. A process according to claim 1 wherein said reacting with sulfur is carried out in the absence of a sulfurization catalyst.

7. A process according to claim 1 wherein said reacting with sulfur is carried out in the presence of a sulfurization catalyst.

8. A process according to claim 7 wherein said catalyst is an amine catalyst.

9. A process according to claim 7 wherein said catalyst is a combination of an amine and a thiadiazole derivative.

10. A process according to claim 9 wherein said thiadiazole derivative is selected from the group consisting of 2,5-dimercapto-1,3,4-thiadiazole and 2,5-bis(t-octyldithio)-1,3,4-thiadiazole derivatives.

11. A process according to claim 7 wherein said catalyst is a compound capable of providing sulfide ions.

12. A process according to claim 7 wherein said catalyst is employed in an amount of from 0.1 to 20 percent by weight based on the weight of the compound to be sulfurized.

13. A process according to claim 7 wherein said catalyst is employed in an amount of from 0.1 to 10 percent by weight based on the weight of the compound to be sulfurized.

14. A process according to claim 7 wherein said catalyst is employed in an amount of from 0.3 to 2 percent by weight based on the weight of the compound to be sulfurized.

15. A process according to claim 1 wherein said reacting with sulfur is carried out in the absence of a solubilizing agent.

16. A process according to claim 1 wherein said reacting with sulfur is carried out in the presence of a solubilizing agent.

17. A process according to claim 16 wherein said solubilizing agent is selected from the group consisting of alloocimene, dibutyl maleate, dodecenyl succinic acid, t-dodecyl mercaptan, ethoxylated tallow amine having an average molecular weight of 482 and containing an average of 5 ethylene oxide residues per molecule, oleic acid, 1,5,9-cyclododecatriene, and mercaptobenzothiazole.

18. A process according to claim 16 wherein said solubilizing agent is employed in an amount of from 2 to 15 molar percent.

19. A process according to claim 1 wherein said reacting with sulfur is carried out using from 0.1 to 4 moles of sulfur per mole of the compound to be sulfurized.

20. A process according to claim 1 wherein said reacting with sulfur is carried out using from 1 to 2 moles of sulfur per mole of the compound to be sulfurized.

21. A process according to claim 1 wherein said compound reacted with sulfur is dicyclopentadiene.

22. A process according to claim 2 wherein said reacting with sulfur is carried out in the absence of a solvent.

23. A process according to claim 2 wherein said reacting with sulfur is carried out in the absence of a sulfurization catalyst.

24. A process according to claim 2 wherein said reacting with sulfur is carried out in the presence of a sulfurization catalyst.

25. A process according to claim 24 wherein said catalyst is an amine catalyst.

26. A process according to claim 25 wherein the catalyst is employed in an amount of from 2 to 10 percent by weight based on the weight of said dicyclopentadiene.

27. A process according to claim 2 wherein said reacting with sulfur is carried out in the absence of a solubilizing agent.

28. A process according to claim 2 wherein said reacting with sulfur is carried out in the presence of a solubilizing agent.

29. A process according to claim 28 wherein said solubilizing agent is selected from the group consisting of alloocimene, dibutyl maleate, dodecenyl succinic acid, t-dodecyl mercaptan, ethoxylated tallow amine having an average molecular weight of 482 and containing an average of 5 ethylene oxide residues per molecule, oleic acid, 1,5,9-cyclododecatriene and mercaptobenzothiazole.

30. A process according to claim 29 wherein said solubilizing agent is employed in an amount of from 1 to 25 molar percent.

31. A process of claim 2, said process comprising reacting sulfur with said dicyclopentadiene at a temperature of 90°–180° C, extracting oil-soluble product from the resultant reaction mixture by dissolving said oil-soluble product in a liquid hydrocarbon solvent and recovering said oil-soluble product.

32. A process for preparing an oil-soluble phosphorus-free substance for use as a lubricating oil additive, which process comprises reacting 1 mole part of a dicyclopentadiene with 0.1–4 mole parts of sulfur at a temperature of about 60°–180° C and in the presence of an amine sulfurization catalyst and a dialkylmaleate.

33. A process of claim 32 wherein said amine is triethylamine.

34. A process of claim 33 wherein said dialkylmaleate is dibutylmaleate.

35. A process of claim 32 wherein said amine is diisopropylamine.

36. A process of claim 35 wherein said dialkylmaleate is dibutylmaleate.

37. A process of claim 32 further characterized by being conducted in the presence of a thiadiazole.

38. A process of claim 37 wherein said thiadiazole is selected from the group consisting of 2,5-dimercapto-1,3,4-thiadiazole and 2,5-bis(octyldithio)-1,3,4-thiadiazole.

39. A process of claim 38 wherein said amine is triethylamine, said dialkylmaleate is dibutylmaleate and said thiadiazole is 2,5-dimercapto-1,3,4-thiadiazole.

40. A process of claim 38 wherein said amine is diisopropylamine, said dialkylmaleate is dibutylmaleate and said thiadiazole is 2,5-bis(octyldithio)-1,3,4-thiadiazole.

* * * * *